US007384507B2

(12) United States Patent
Bond

(10) Patent No.: US 7,384,507 B2
(45) Date of Patent: Jun. 10, 2008

(54) WATERMARKED PAPER

(75) Inventor: Donald Jeffrey Bond, Devon (GB)

(73) Assignee: Arjo Wiggins Fine Papers Limited, Basingstoke (GB)

( * ) Notice: Subject to any disclaimer, the term of this patent is extended or adjusted under 35 U.S.C. 154(b) by 552 days.

(21) Appl. No.: 10/466,416

(22) PCT Filed: Nov. 15, 2002

(86) PCT No.: PCT/GB02/05180

§ 371 (c)(1),
(2), (4) Date: Nov. 10, 2004

(87) PCT Pub. No.: WO03/044278

PCT Pub. Date: May 30, 2003

(65) Prior Publication Data

US 2005/0064150 A1 Mar. 24, 2005

(30) Foreign Application Priority Data

Nov. 17, 2001 (GB) ..... 0127576.7

(51) Int. Cl.
*D21H 11/00* (2006.01)

(52) U.S. Cl. ..... 162/140; 428/195.1; 347/107; 347/100; 162/100; 162/116; 162/146

(58) Field of Classification Search ..... 162/140, 162/116, 146, 110, 117; 283/72, 113; 482/195.1; 347/107
See application file for complete search history.

(56) References Cited

U.S. PATENT DOCUMENTS

| | | | |
|---|---|---|---|
| 1,384,290 | A | 7/1921 | Winchenbaugh et al. |
| 1,901,049 | A | 3/1933 | Von Heinrich |
| 6,368,455 | B1 | 4/2002 | Missell et al. |
| 6,531,032 | B2 | 3/2003 | Missell et al. |
| 2002/0088580 | A1 | 7/2002 | Missell et al. |

*Primary Examiner*—Mark Halpern
(74) *Attorney, Agent, or Firm*—Birch, Stewart, Kolasch & Birch, LLP

(57) ABSTRACT

Watermarked paper, preferably shadow-watermarked paper is produced in conventional manner and then size-press dyed using a pigment dyestuff composition. This results in unusual and attractive decorative effects as a result of preferential dye take-up in parts of the watermarked areas, resulting in enhanced contrast between watermarked and non-watermarked areas of the paper. The invention finds particular application in wallpaper base, but can also be used in decorative or security papers. The pigment dyestuff can be fluorescent for security paper use.

8 Claims, No Drawings

WATERMARKED PAPER

This application is the national phase under 35 U.S.C. § 371 of PCT International Application No. PCT/GB02/05180 which has an International filing date of Nov. 15, 2002, which designated the United States of America.

This invention relates to dyed watermarked paper suitable for conversion into wallpaper or for use for decorative, security or other purposes.

Watermarking is a long-established paper industry technique for incorporating words, images and patterns into paper in an unobtrusive manner which does not interfere with the use to which the paper is to be put but which indicates the origin of the paper or guarantees that it is genuine. Thus watermarking is widely employed in the manufacture of banknotes, security papers, and high-quality branded or bespoke stationery for business or personal use. The watermark image is produced by inducing localized variation in the thickness of the paper. This in turn creates localized variation in the opacity and texture of the paper, and so creates a contrast which makes the watermark visible, particularly in transmitted light. The desired localized variation in paper thickness is typically effected by fibre displacement by means of a so-called dandy roll which runs on top of the wet web on the wire of a Fourdrinier papermachine and carries an array of electrotype- or intaglio-type designs corresponding to the watermark to be applied.

Electrotype designs stand proud of the surface of the dandy roll, and so the fibre displacement they cause results in localized thinning of the paper, and therefore areas of reduced opacity/greater light transmittance. By contrast, intaglio designs are recessed into the dandy roll surface, usually by embossing, and so the fibre displacement they cause results in localized thickening of the paper and therefore areas of greater opacity/lesser light transmittance. These areas appear darker than the surrounding paper when held up to the light, and so are often referred to as "shadow" or "shade" watermarks.

It is also common when embossing a dandy roll with an intaglio design to incorporate raised as well as recessed areas in the dandy roll surface. The resulting papers therefore include areas of both greater and reduced thickness and opacity, and this enables aesthetically pleasing high-contrast watermarks to be produced, with shading, half-tones and fine detail.

In the case of a cylinder mould papermachine, the wire mesh of the mould can be adapted to carry similar electrotype- or intaglio-style designs which likewise give rise to localized variation in paper thickness and watermarking effects as already described.

Although watermarking has hitherto generally been used to indicate the origin or genuineness of the paper, this does not preclude the simultaneous achievement of a decorative effect. Conventionally, however, such an effect is limited by its inherently monochrome character, i.e. the watermarked paper is either white or is dyed to a single uniform colour by addition of a direct dye to the pulp suspension from which the paper is made.

We have now discovered that unusual and attractive decorative or security effects can be achieved with a watermarked paper, particularly where the watermark is a shadow watermark, if the paper is size-press dyed after it has been produced using one or more pigment dyestuffs. Such dyestuffs differ from the soluble direct dyestuffs commonly used for colouring paper during its production. The decorative effect appears to result from selective preferential dye take-up in parts of the watermarked areas of the paper, and a consequential enhanced contrast between the watermarked and non-watermarked areas of the paper. The preferential dye take-up is at its greatest in relatively thick areas of the paper and this is thought to be the reason why the most noticeable and attractive effects are obtained with a paper which has been shadow-watermarked.

Accordingly, the present invention provides, in a first aspect, a method of producing a dyed watermarked paper wherein paper carrying a watermark, preferably a shadow watermark, is produced on a papermachine in conventional manner, characterized in that dyeing is carried out at the size press of the papermachine using a pigment dyestuff composition.

In a second aspect, the present invention resides in dyed watermarked paper produced by a method according to said first aspect of the invention.

The pigment dyestuff composition can be made up in conventional manner, for example by initial dispersion in water in a holding or mixing tank, followed by transfer to a high shear mixer and thence to the size press.

The use of pigment dyestuffs as opposed to more commonly used and cheaper soluble dyestuffs gives a more pronounced decorative or security effect. It also makes it easier to control batch-to-batch colour shade variations, and leads to a more fade-resistant pattern in the final product. The pigment dyestuff used can provide colour under normal daylight illumination or it can be fluorescent so as to provide colour under ultra-violet illumination for security paper applications. A combination of fluorescent and non-fluorescent pigment dyestuffs can also be used.

The present invention can be applied to Fourdrinier or cylinder mould papers of a wide range of basis weights (grammages), including heavyweight papers of the kind sometimes referred to as card or board.

The size press used in the present method may be of the kind traditionally used in papermaking, or of the modified form known as a metered size press and commercialised more recently under names such as the "Speedsizer" by Voith Sulzer, the "Symsizer" by Valmet, the "Film Press" by Jagenberg, and the "Twin-HSM" by BTG Kalle.

The present invention can advantageously be applied to the production of wallpaper base. For this application, it is important that the product should have a high bulk for a given grammage, and yet be strong with good dimensional stability. Accordingly the furnish should contain a blend of a major proportion of hardwood pulp to provide the desired bulk characteristics and a minor, but still quite high, proportion of softwood pulp to provide strength and dimensional stability. The hardwood pulp can be for example, eucalyptus or birch pulp. The softwood pulp can be, for example, Kraft or pine pulp. We have found a blend of about 70% by weight of eucalyptus pulp and 30% by weight of Kraft or pine softwood pulp to be particularly suitable. No filler, dyestuffs, or optical brightening agent ("OBA") or broke containing these materials should be included in the furnish (the presence of filler would be likely to produce undesirable two-sidedness in the sheet, and the presence of dyestuffs or OBA would be likely to interfere with the subsequent dyeing of the paper, making it difficult to control batch-to-batch variations in shade). The presence of soluble dyestuffs would also be likely to result in gradual colour change, as soluble dyestuffs are prone to fading, particularly when permanently exposed to light as in the case of wallpaper.

The furnish desirably also includes a conventional amount of a wet strength agent, say 1.5 to 1.7% by weight, based on dry fibre content, and an internal sizing agent, for example a resin/polyaluminium chloride (PAC) composition in an amount of about 2% by weight, based on dry fibre content.

When a dandy roll is used, to form the watermark, we have found it advantageous to drive the dandy roll slightly faster than the papermachine wire. This "drags" more fibre into the recessed areas of the dandy roll and produces a more pronounced shadow effect whilst maximising the dimensional stability of the paper. The resulting increased fibre content results in higher pigment take up during the subsequent dyeing operation, and so in an enhanced colouring effect and a more prominent watermark.

After production and dyeing of the paper, it is normally calendered in conventional manner to a desired smoothness value, although this is not critical. In this context, smoothness can conveniently be measured in terms of a Bendtsen roughness value. We have found a Bendtsen roughness value of 350-400 ml $min^{-1}$ is suitable, but the invention can be applied to papers with higher Bendtsen values, i.e. rougher papers, to achieve particular desired aesthetic effects.

After calendering, the paper can be reeled up for subsequent conversion into rolls of wallpaper or paper for other end uses. In the case of wallpaper, the rolls can be directly prepasted if desired, or the dyed watermarked paper can be laminated onto a backing paper which can itself be prepasted.

When the present invention is employed in the manufacture of security papers, or decorative papers, for example decorative printing papers, the furnish and production methods used can be as is conventional for those types of paper.

Although the invention is particularly suited to pigment-dyed shadow-watermarked papers, we have observed that a more modest colour—accentuation effect is obtained with embossed watermarks. For example, the lines on a discrete image embossed watermark can be made more visible by pigment dyeing.

The invention will now be illustrated by the following Examples in which all parts and percentages are by weight unless otherwise stated:

EXAMPLE 1

A 70% eucalyptus hardwood/30% Kraft softwood fibre stock was prepared in conventional manner in a pulper at about 5 to 6% consistency and refined in a generally conventional manner appropriate to the production of a high bulk yet strong and dimensionally stable paper suitable for use as a wallpaper base. The resulting stock was then pumped to a header tank, diluted, and projected on to a Fourdrinier papermaking wire from a headbox slice to produce paper in the normal way. The process conditions were selected with the aim of producing a final dried paper of a grammage of about 120 g $m^{-2}$ (after size-press sizing and dyeing). No fillers, dyestuff or OBA were present, but the stock contained 1.7% wet strength agent, based on the dry weight of as-supplied pulp used, and 2% resin/PAC internal sizing agent. The papermachine was equipped with a shadow-watermarking dandy roll which imparted an all-over diagonal lattice pattern of which the lines of the lattice resembled a rope (a "cordage" pattern).

The papermachine was equipped with a horizontal size press to which a beige-green pigment dyestuff size composition was supplied at approximately 40% solids content. The size press formulation was as follows:

| | Parts |
|---|---|
| Pigment dyestuff | 10 |
| Starch | 8 |
| Water | 82 |

The size press pick-up was approximately 4% on a dry basis, and the average grammage of the final product was 125 g $m^{-2}$. The mean Bendtsen roughness after calendering was 385 ml $min^{-1}$.

The product had an attractive appearance, with the cordage watermark pattern clearly visible in both reflected and transmitted light. The colouring in certain areas of individual plies of the "rope" was noticeably accentuated, giving an unusual and attractive effect.

EXAMPLE 2

The procedure of Example 1 was repeated, except that a violet pigment dye formulation was used and two differently-watermarked papers were produced. The pattern for the first of these was as in Example 1, but the second had a continuous wavy line or "spaghetti" watermark pattern, achieved by the use of a different dandy roll. The size press formulation was:

| | Parts |
|---|---|
| Pigment dyestuff | 5 |
| Starch size | 8 |
| Water | 87 |

The size press pick-up was approximately 4%, and the final product had an average grammage of 120 g $m^{-2}$. The mean Bendtsen roughness value after calendering was 385 ml $min^{-1}$.

Both of the products had an attractive appearance, with the watermark pattern clearly visible in both reflected and transmitted light. The colouring in certain areas of individual plies of the "rope" and "spaghetti" watermark patterns was noticeably accentuated, giving an unusual and attractive effect.

The invention claimed is:

1. A method of producing a dyed watermarked paper, wherein paper carrying a shadow watermark is produced on a paper machine in conventional manner, characterized in that dyeing is carried out at the size press of the paper machine using a pigment dyestuff composition.

2. A method as claimed in claim 1, wherein the shadow watermark is applied by means of a dandy roll which is driven slightly faster than the paper machine wire.

3. A method as claimed in any preceding claim, wherein the pigment dyestuff provides color under daylight illumination.

4. A method as claimed in claims 1 or 2, wherein the pigment dyestuff is fluorescent and provides color under ultra-violet illumination.

5. A method as claimed in claim 1, wherein the paper is a wallpaper base made from a blend of a major proportion of hardwood pulp to provide bulk characteristics and a minor, but still quite high, proportion of softwood pulp to provide strength and dimensional stability.

6. A method as claimed in claim 5, wherein said blend comprises about 70% by weight of eucalyptus pulp and 30% by weight of Kraft or pine softwood pulp.

7. A method as claimed in claim 5 or claim 6, wherein the paper is calendered to a Bendtsen roughness value of about 350-400 ml $mint^{-1}$.

8. A method as claimed in claim 1, wherein the paper is a security paper or a decorative paper.

* * * * *